US006439452B1

(12) United States Patent
Tsao

(10) Patent No.: US 6,439,452 B1
(45) Date of Patent: Aug. 27, 2002

(54) CONTAINER FOR SEPARATELY CARRYING COLD DRINK AND HOT FOODS

(76) Inventor: Chung-Piao Tsao, 4F, No. 22, Lane 346, Kuang-Fu S. Road, Taipei (TW)

( * ) Notice: Subject to any disclaimer, the term of this patent is extended or adjusted under 35 U.S.C. 154(b) by 0 days.

(21) Appl. No.: 09/941,297

(22) Filed: Aug. 24, 2001

(51) Int. Cl.[7] ..... B65D 5/489

(52) U.S. Cl. ..... 229/120.15; 206/217; 229/117.14; 229/904

(58) Field of Search ..... 229/117.14, 120.15, 229/904; 206/217, 218, 193–198

(56) References Cited

U.S. PATENT DOCUMENTS 2,794,585 A * 6/1957 Wagner ..... 229/904
2,997,223 A * 8/1961 Zastrow ..... 229/120.15
3,013,710 A * 12/1961 Kronson et al. ..... 229/120.15
4,397,393 A * 8/1983 Pergande et al. ..... 229/117.14
4,601,390 A * 7/1986 Rosenthal et al. ..... 229/120.15
5,524,814 A * 6/1996 Davis ..... 229/120.15
5,775,570 A * 7/1998 Kim ..... 229/904
5,850,911 A * 12/1998 Pakzad ..... 206/217

* cited by examiner

*Primary Examiner*—Gary E. Elkins

(57) ABSTRACT

A container includes a container body defining a hot-storage chamber for storing hot foods therein and a partition member foldably formed in a side portion of the container body to form a cold-storage chamber as partitioned from the hot-storage chamber for storing cold drink in the cold-storage chamber, thereby thermally insulating the cold drink from the hot foods for maintaining good quality of the foods and drink.

4 Claims, 6 Drawing Sheets

CONTAINER FOR SEPARATELY CARRYING COLD DRINK AND HOT FOODS

BACKGROUND OF THE INVENTION

A conventional method for carrying fast foods and cold drinks includes respective storing of hot foods and cold drink cup into two separate bags and then together putting the two bags into a big bag for carrying purpose. The hot foods will become cool as contacting and influenced by the cold drink; and the cold drink will not be cool by the heat conducted from the hot foods, thereby deteriorating the quality of the foods and drink.

The present inventor has found the drawbacks of the conventional container for hot foods and cold drink and invented the present container for separately carrying the cold drink and hot foods.

SUMMARY OF THE INVENTION

The object of the present invention is to provide a container including a container body defining a hot-storage chamber for storing hot foods therein and a partition member foldably formed in a side portion of the container body to form a cold-storage chamber as partitioned from the hot-storage chamber for storing cold drink in the cold-storage chamber, thereby thermally insulating the cold drink from the hot foods for maintaining good quality of the foods and drink.

DETAILED DESCRIPTION

Figure 1:
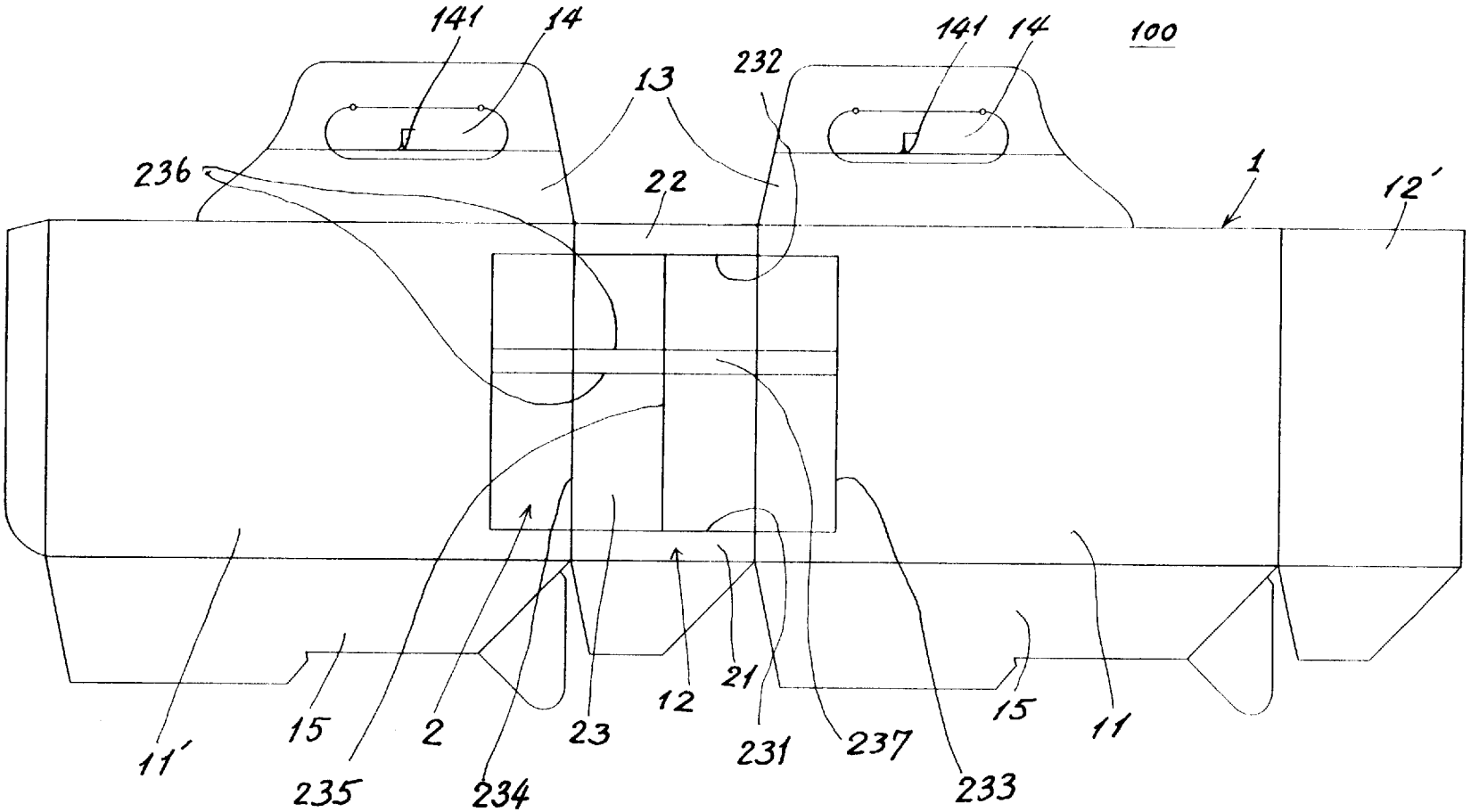
FIG. 1 is a plan view of the board of the present invention as unfolded.

As shown in FIGS. 1~4, the container of the present invention comprises: a container body 1 and a partitioning means 2 integrally formed and folded from a flat board 100 including paper or plastic boards and other sheet members.

The container body 1 includes a front wall 11, a rear wall 11', a left side wall 12, a right side wall 12', a bottom wall 15 and a pair of handle members 13 interlocked for carrying purpose.

Each handle member 13 includes: a flap 14 cut out in the handle member 13 to form a hand hole or finger hole for passing a user's hand or fingers therethrough for holding the handle member 13, and a locking tab 141 formed on each flap 14 by cutting a slit such as L shape or T shape in the flap 14, whereby upon interlocking of the two flaps 14 of the two handle members 13 by engaging the two locking tabs 141 together, the two handle members 13 will be coupled to serve as s handle for carrying the container of the present invention.

The front and rear walls 11, 11'; the left and right side walls 12, 12' and the bottom wall 15 simultaneously form a hot storage chamber 10 within the container body 1 for storing hot foods (such as hamburger, French fries etc.) in the chamber 10.

The partitioning means 2 includes: a bottom edge portion 21 formed among the front wall 11, rear wall 11' and the left side wall 12 (or right side wall 12'); an upper fastening band 22 formed between the front wall 11 and the rear wall 11' and the band 22 formed on an upper portion of the left side wall 12 (or right side wall 12'); and a partition member 23 formed between the upper fastening band 22 and the bottom edge portion 21 and operatively recessed inwardly to form a cold storage chamber 20 (from FIG. 2 to FIG. 3 or 4) in the partitioning means 2 for storing cold drink (such as coke) cup in the cold storage chamber 20.

The partition member 23 includes: a lower cutting line 231 horizontally cut between the bottom edge portion 21 and the partition member 23, an upper cutting line 232 horizontally cut between the upper fastening band 22 and the partition member 23, and a pair of main folding lines 233 each vertically formed between the front wall 11 (or rear wall 11') and the partition member 23; whereby upon an inward depression or folding of the partition member 23 towards the hot storage chamber 10 of the container body 1, the cold storage chamber 20 will be formed and recessed in a side portion of the container body 1 for storing cold drink cup C in the cold storage chamber 20 to be thermally insulated and separated from the hot foods as stored in the hot storage chamber 10 in the container body.

The cold drink and the hot foods will not be influenced mutually. The cold drink cup C is confined within the upper fastening band 22, the bottom edge portion 21 and the recessed partition member 23, thereby being stably held to prevent from collapse or release of the cup C from the chamber 20.

Figure 4:
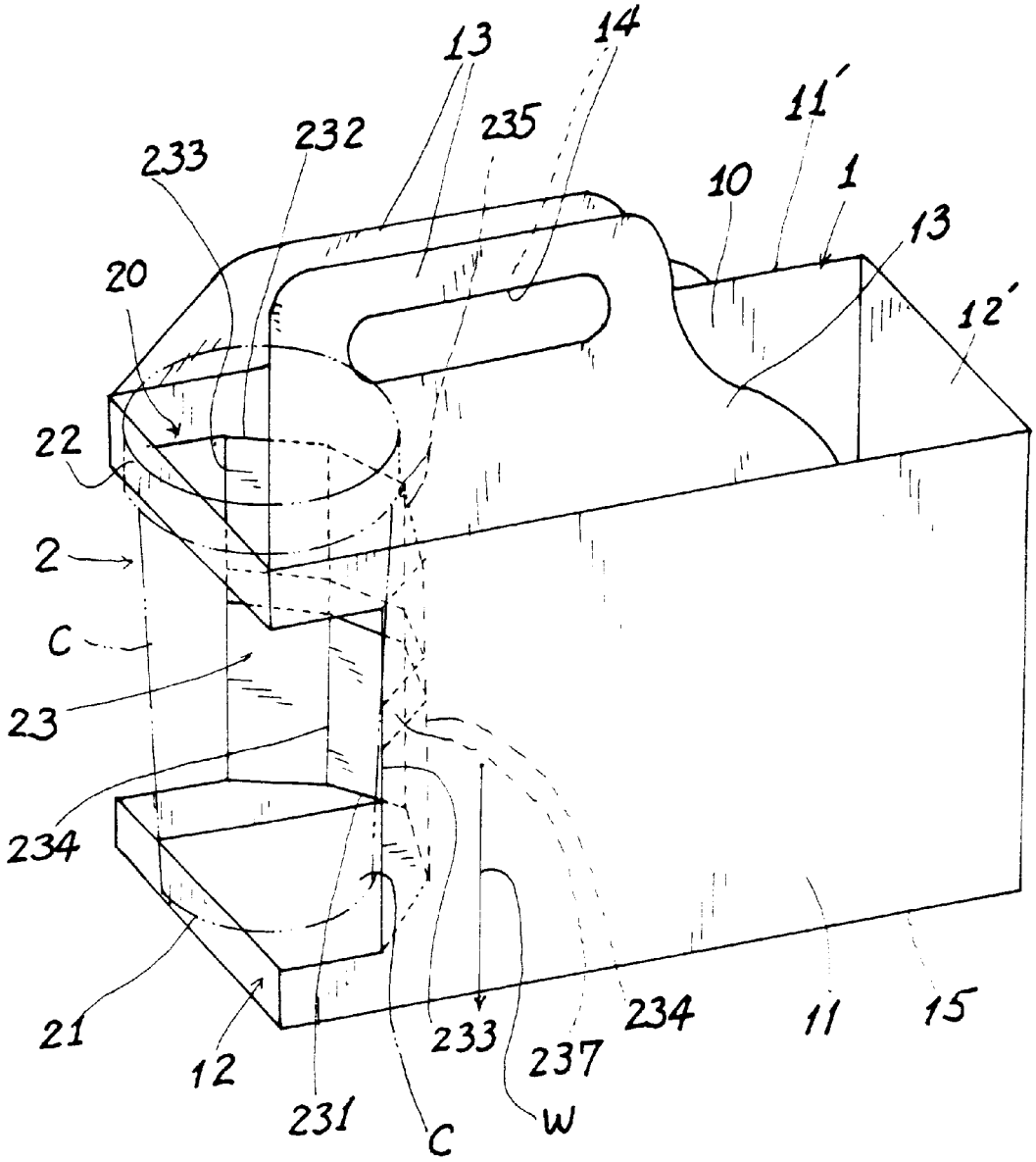
FIG. 4 shows the storage of cold drink cup in device of FIG. 3.

The pair of handle members 13 of the present invention may be eccentrically formed on the front and rear walls 11, 11' of the container body 1 to approximate the cold storage chamber 20 of the partitioning means 2 and to align with the gravity center W of the container when loaded with hot foods and cold drink to be gravitationally balanced since the cold drink cup may always be heavier than the hot foods as stored in the hot storage chamber 10 (FIG. 4).

Figure 5:
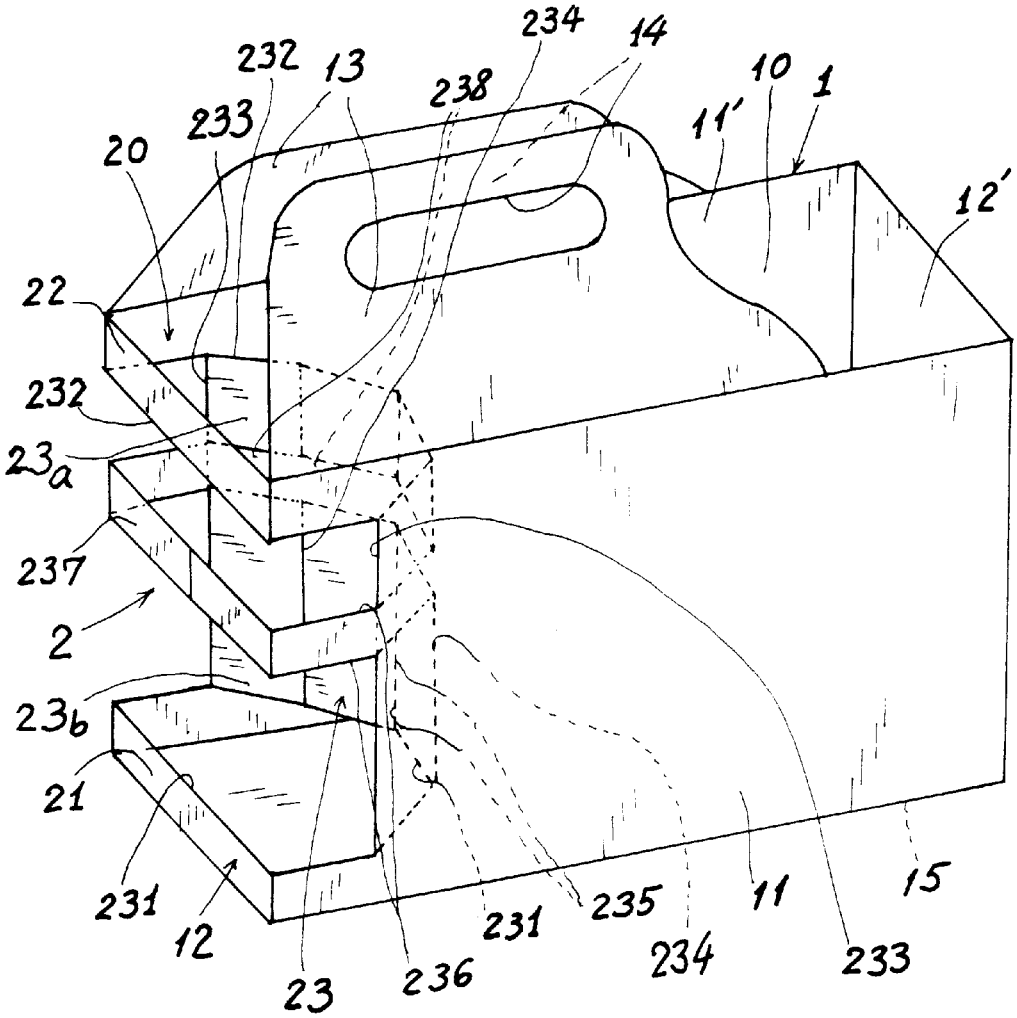
FIG. 5 shows another folding operation to form the cold-storage chamber of the present invention.
Figure 6:
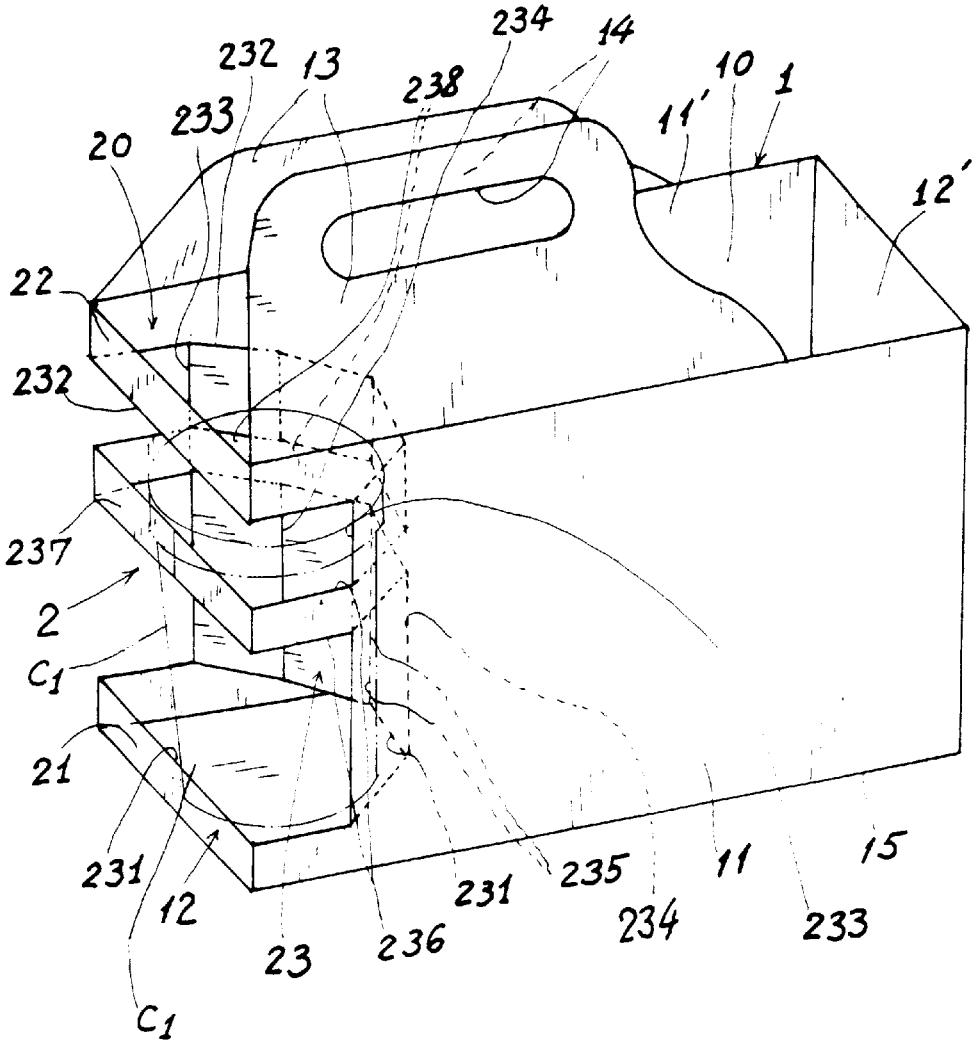
FIG. 6 shows the storing of small cold drink cup in device of FIG. 5.

The partition member 23 further includes: a middle fastening band 237 having a pair of middle cutting lines 236 respectively horizontally cut between the middle fastening band 237 and an upper portion (23*a*) (or a lower portion 23*b*) of the partition member 23; whereby upon an inward depression of the upper and lower portions (23*a*, 23*b*) of the partition member 23, the middle fastening band 237 will be formed (from FIG. 2 to FIG. 5 or 6) for storing a middle or small cold drink cup C1 in the cold storage chamber 20 as confined by the middle fastening band 237 and the bottom edge portion 21 for stably storing the middle or small cup Cl. When the middle fastening band 237 is formed as shown in FIG. 5, two band slots 238 (as dotted line shown) will be formed in the inwardly folded upper portion 23*a* and lower portion 23*b* of the partition member 23.

Figure 2:
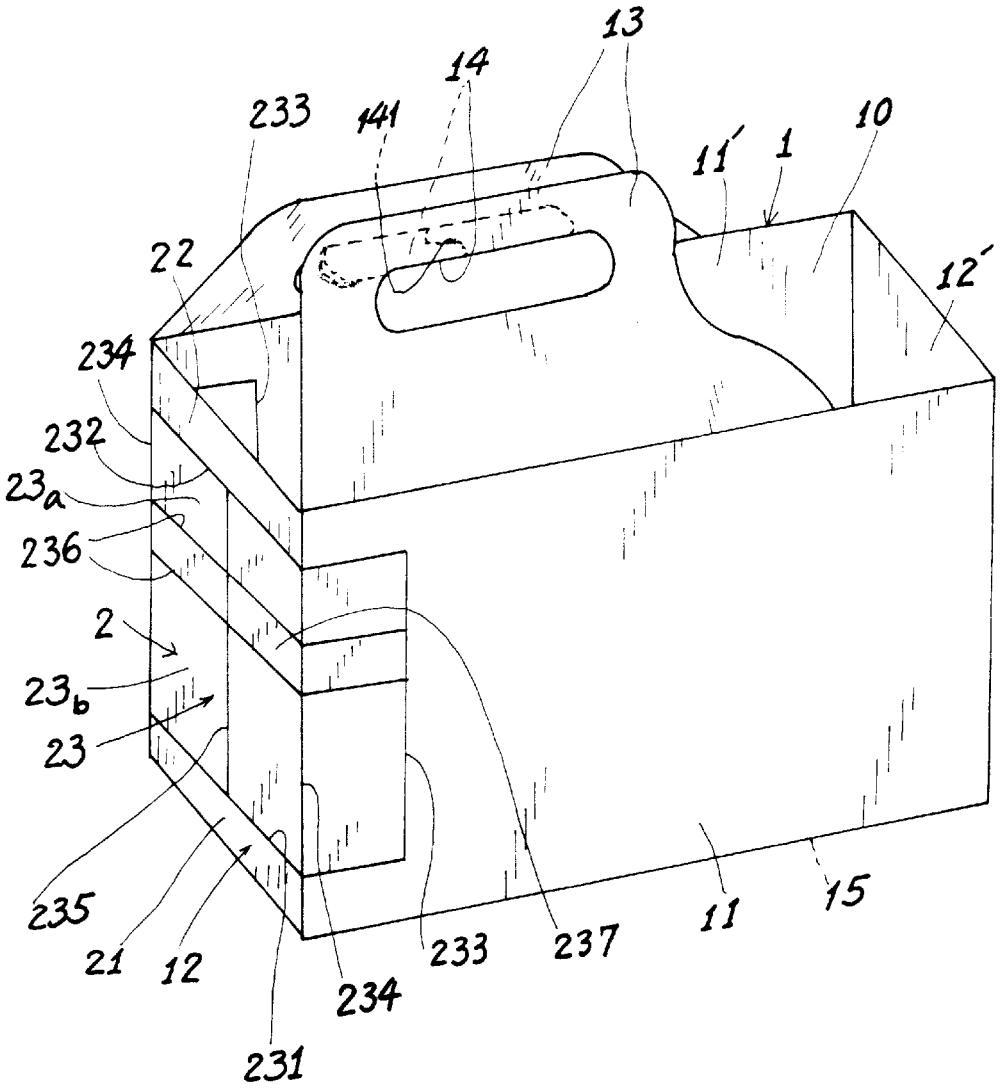
FIG. 2 is a perspective view of the present invention when assembled.
Figure 3:
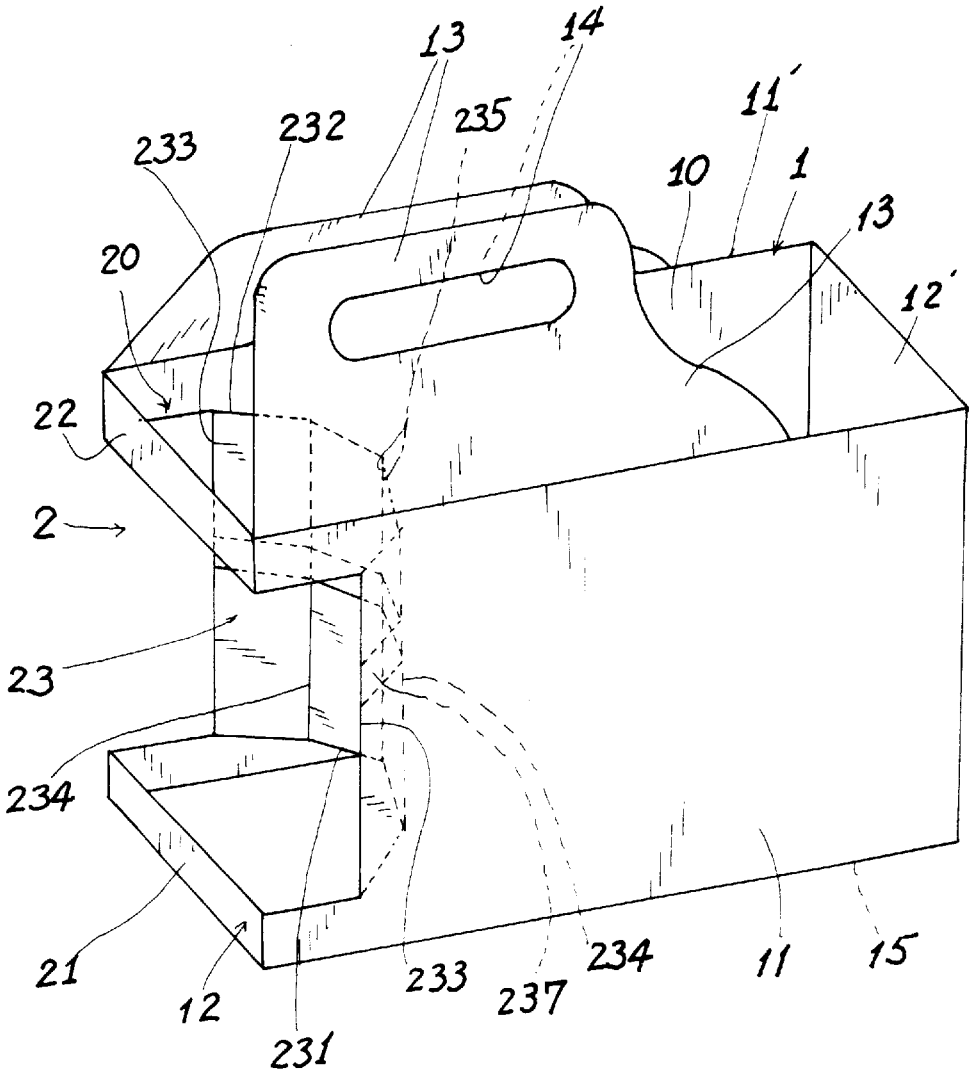
FIG. 3 is an illustration when folded to form a recessed coldstorage chamber from FIG. 2.

The partition member 23 is also formed with a central vertical folding line 235 at a longitudinal center of the partition member 23 and two side vertical folding lines 234 each vertically formed at a right-angle ridge portion between the left side wall 12 and the front wall 11 (or rear wall 11'), whereby upon an inward depression of the partition member 23 from FIG. 2 to FIG. 3, the central vertical folding line 235 and the two side vertical folding lines 234 may help fold the partition member 23 inwardly quickly for forming the cold storage chamber 20 for storing cold drink cup C, C1 therein.

The present invention may be modified without departing from the spirit and scope of the present invention. The shapes, materials, folding or unfolding mechanisms of the container are not limited in the present invention.

I claim:

1. A container for separately carrying cold drink and hot foods comprising:

a container body formed by a front wall, a rear wall, at least a side wall and a bottom wall defining a hot storage chamber among said walls for storing hot foods in said hot storage chamber; and a partitioning means formed in one said side wall of said container body having a cold storage chamber formed in said partitioning means and said cold storage chamber partitioned from said hot storage chamber in said container body for storing cold drink in said cold storage chamber to be thermally insulated from said hot storage chamber;

said partitioning means including: a bottom edge portion formed among the front wall, the rear wall and one said side wall; an upper fastening band formed between the front wall and the rear wall, and said upper fastening band formed on an upper portion of said side wall; and a partition member formed between the upper fastening band and the bottom edge portion and operatively recessed inwardly to form said cold storage chamber in the partitioning means for storing a cold drink cup in the cold storage chamber; and said partition member further including: a middle fastening band having a pair of middle cutting lines respectively horizontally cut between the middle fastening band and an upper portion or a lower portion of the partition member; whereby upon an inward depression of the upper and lower portions of the partition member, the middle fastening band will be formed for storing a small cold drink cup in the cold storage chamber as confined by the middle fastening band and the bottom edge portion for stably storing the small cup.

2. A container according to claim 1, wherein said partition member includes: a lower cutting line horizontally cut between the bottom edge portion and the partition member, an upper cutting line horizontally cut between the upper fastening band and the partition member, and a pair of main folding lines each vertically formed between the front wall or rear wall and the partition member; whereby upon an inward depression of the partition member towards the hot storage chamber of the container body, the cold storage chamber will be formed and recessed in a side portion of the container body for storing the cold drink cup in the cold storage chamber to be thermally insulated and separated from the hot foods as stored in the hot storage chamber in the container body.

3. A container according to claim 1, wherein said container body further includes a pair of handle members eccentrically formed on the front and rear walls of the container body to approximate the cold storage chamber of the partitioning means to be gravitationally balanced as the cold drink is heavier than the hot foods as stored in the hot storage chamber.

4. A container according to claim 1, wherein said partition member is formed with a central vertical folding line at a longitudinal center of the partition member and two side vertical folding lines each vertically formed at a right-angle ridge portion between one said side wall and the front wall or rear wall, whereby upon an inward depression of the partition member, the central vertical folding line and the two side vertical folding lines will help fold the partition member inwardly quickly for forming the cold storage chamber for storing cold drink cup therein.

* * * * *